US005410756A

United States Patent [19]

Hutson

[11] Patent Number: 5,410,756

[45] Date of Patent: May 2, 1995

[54] BODY ARMOR WITH THERMOFORMABLE SHOCK DISPERSING MEANS

[76] Inventor: John Hutson, 877 Hillhaven Ct., Nashville, Tenn. 37220

[21] Appl. No.: 289,495

[22] Filed: Aug. 12, 1994

Related U.S. Application Data

[63] Continuation of Ser. No. 25,595, Mar. 3, 1993, abandoned.

[51] Int. Cl.[6] ..... A41D 13/00

[52] U.S. Cl. ..... 2/2; 2/16; 2/22; 2/24; 2/45; 2/267; 602/5; 602/20; 602/60

[58] Field of Search ..... 2/2.5, 2, 16, 22, 24, 2/45, 44, 267, 268, 94, 309, 310, 336, 338, 421, 452; 602/5, 6, 12, 20, 21, 23, 26, 60, 61, 62, 63, 64; 24/265 AL, 198, 714.8; 224/197, 151, 202

[56] References Cited

U.S. PATENT DOCUMENTS

| | | | |
|---|---|---|---|
| 997,080 | 4/1911 | Myers | 2/310 |
| 1,821,239 | 9/1931 | Scott | 24/265 AL |
| 2,377,339 | 6/1945 | Greene | 2/24 |
| 2,550,461 | 4/1951 | Fick | 2/16 |
| 3,044,075 | 7/1962 | Rawlings | 2/22 |
| 3,383,708 | 5/1968 | Pappas | 2/22 |
| 3,411,222 | 11/1968 | Williams | 2/24 |
| 3,458,867 | 8/1969 | Moore et al. | 2/16 |
| 3,504,377 | 4/1970 | Biggs, Jr. et al. | 2/2 |
| 4,320,537 | 3/1982 | Mitchell | 2/2 |
| 4,599,747 | 7/1986 | Robinson | 2/44 |
| 4,641,641 | 2/1987 | Strock | 2/2 |
| 4,805,239 | 2/1989 | Ciago | 2/22 |
| 4,905,681 | 3/1990 | Glascock | 2/22 |
| 4,953,569 | 9/1990 | Lonardo | 2/24 |

OTHER PUBLICATIONS

Gershman, M. D., Maurice "Self-Adhering Nylon Tapes", Journal of the American Medical Association, vol. 68, No. 7, p. 930.

*Primary Examiner*—Clifford D. Crowder
*Assistant Examiner*—Gloria Hale
*Attorney, Agent, or Firm*—Rick R. Wascher

[57] ABSTRACT

A protective body pad comprising a thermoformable base component and a shock dispersing prominence component. In the preferred embodiment thereof, the prominence is integral with said base component. A plurality of swivel components having flexible strapping attached thereto enables the user to fasten the invention to various points on the body. The strapping is preferably a neoprene material with hook and loop material for the fastening.

20 Claims, 2 Drawing Sheets

FIG. 3
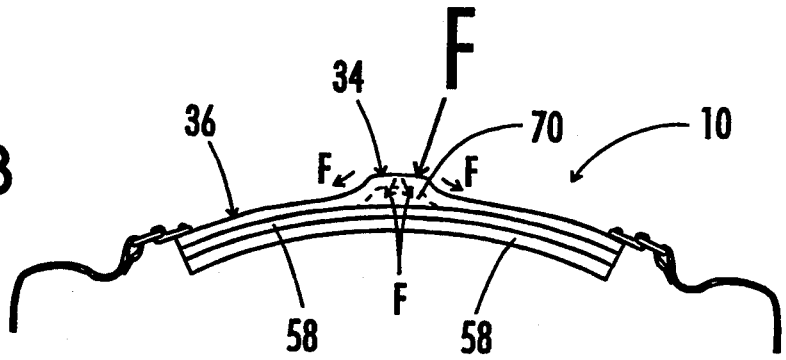
FIG. 4A
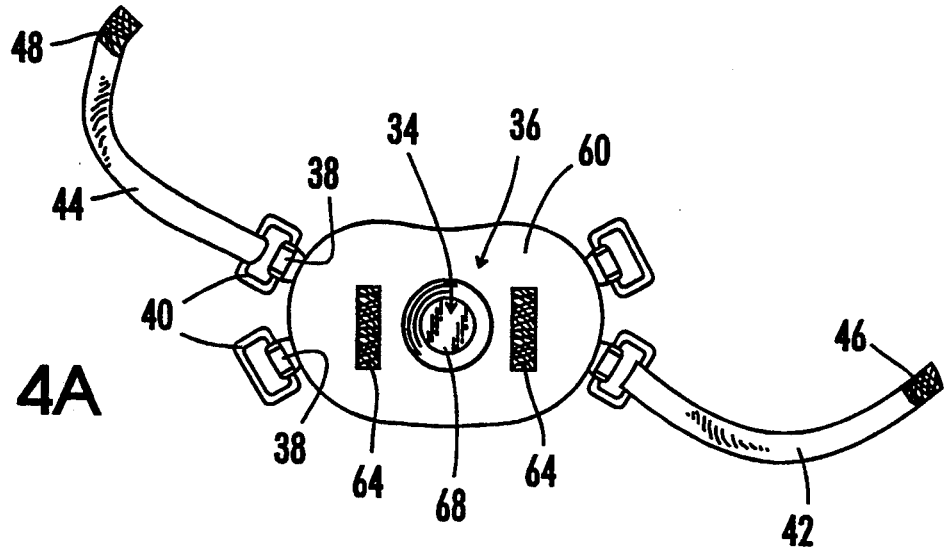
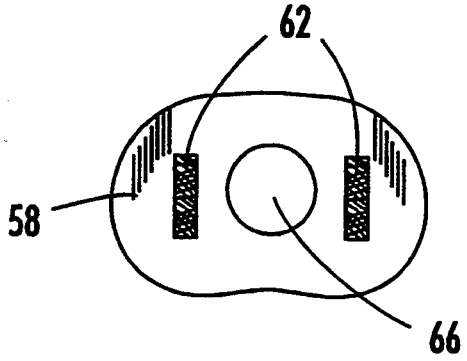
FIG. 4B
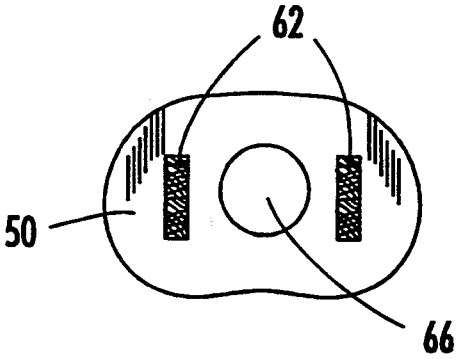
FIG. 4C

BODY ARMOR WITH THERMOFORMABLE SHOCK DISPERSING MEANS

This is a continuation of application Ser. No. 08/025,595 filed on Mar. 3, 1993, now abandoned.

BACKGROUND OF THE INVENTION

1. Field of the Invention

The present invention relates to equipment and body protection devices used to shield the body from impact forces, but more particularly to body armor and pads used by athletes participating in high contact sports.

2. Description of the Related Art

In the plastics industry it is well known that there exists two primary classes of plastic materials. The two classes are (i.) thermoset plastics, and (ii.) thermoplastics ("thermoformable plastics". Examples of thermoset plastics include urethanes, phenolycs, vinyl resins, and polyester gels. In the industry, it is well known that vinyls were only of the thermoset variety until the late 1960's or early 1970's when the technology improved enabling them to also be made as thermoplastic plastics.

It is also well known that virtually 99% of all vinyls existing today are of the thermoset variety, because thermoset vinyls become sticky at temperatures as low as 120 degrees fahrenheit. The shape of thermoset plastics, as their name implies, are set once and for all by temperature during the forming process. Thermoset plastics do not melt and cannot be reformable by subsequent reforming and heating steps, because they do not plasticize.

Thermoplastics (thermoformable plastics), on the other hand, are reformable and reshapeable during subsequent heating and forming steps after the initial shape and formed is selected. Polyethylene is a thermoformable plastic. Polyethylene does not have a sharp melting rise, thus it can be reheated and reformed by immersion in hot water, reshaped and allowed to cool to retain the new shape.

Foam insulations are also known in the industry to have specific properties. Closed cell foams trap air within the macroscopic pockets or bubbles of the foam. Thus they are typically not used in conjunction with thermoformable plastic materials because they too cannot be reshaped. Open cell foams on the other hand are said to breath and thus are readily reshapeable and bendable because they enable air to pass through the body of the foams via the open cells, pockets or bubbles. Open cell foams are typically incorporated with thermoformable plastic materials because they too can be readily reshaped.

Stiffeners, which are commonly added to plastics, enable the plastic to remain rigid in an original shape and thus, by design, resist reshaping. In fact, stiffeners are added to plastics when it is desirable to have a plastic not capable of being reshaped during subsequent heating and forming processes after the initial heating and forming operation.

In addition, it also well known in the industry that laminate structures having a plurality of layers bonded together with adhesives are thermoset devices, otherwise the layers might separate and the laminate structure would separate, which is believed to be an undesirable characteristic.

Athletes participating in high contact sports such as football and hockey, must wear protective padding and body armor to protect and shield the body from impact forces. For example, football players are known to wear protective shoulder pads, thigh pads, hip and tailbone pads, as well as various rib protecting corsets. The aforementioned devices are designed to provide a series of shock absorbing layers of material over the surface of the body and located at various critical areas. The critical areas include joints, large muscle groups, thin bones, and other locations simply as a means to maintain kinematic alignment of human body parts.

The related devices have a stacked material configuration, using a series of foam pads topped by a hard shell made from a variety of materials, are not particularly useful for redistributing the impact forces on the shell. The related art devices, therefore, are designed predominantly for impact absorption.

Impact absorbing devices still transmit a reduced amount of pressure force directly over the site to be protected.

Further, such devices are often very difficult to apply and are not configured so as to conform to the anatomy of the human body. For example, a set of shoulder pads worn by a football player incorporates numerous laces, straps, buckles and clasps which all require fastening prior to donning the jersey for play.

The related devices also have the limitation that they are not necessarily interchangeable between players. That is, a single set of shoulder pads, thigh pads, hip pads and the like would not fit each player considering the disparity in the body composition of one player as compared to another.

The art to which the invention relates includes U.S. Pat. No. 3,044,075 granted to Rawlings on Jul. 17, 1962 from an application filed Mar. 28, 1960. From column 2, lines 11–12, the Rawlings invention includes a central mounting stiffener. Like all stiffeners, it cannot be reshaped because it is a thermoset plastic. Further, from column 2, lines 16–21 of Rawlings, the stiffener member or core may be made of any relatively stiff, but slightly flexible material, such as a plastic composition or pressed fiber mixed with suitable plastic and stiffener formed under pressure and heat. Such stiffeners, again, are thermoset and the plastics into which they are incorporated are also thermoset by virtue of the added stiffener.

From column 2, lines 33–35, "[t]he material 4 may be polyether, polyurethane, or polyester foam materials." These too are thermoset materials and correspond to the thermoset nature of the Rawlings device. Still further, from column 2, line 37 of Rawlings, foam rubber is also used by Rawlings. Foam rubber is also a thermoset material.

Thus the laminate configuration of the Rawlings device incorporates a plurality of layers bonded together to form the invention by the use of adhesives. As is known in the industry, laminate structures are not thermoformable, they are thermoset.

Accordingly, the protective pad which can be easily attached, molded to fit a variety of users, and having shock dispersing means in conjunction with shock absorbing means of the type described herein, has not been invented.

SUMMARY OF THE INVENTION

The present invention comprises a protective shell having a base component and at least one shock dispersing prominence. The prominence projects a distance above the base component, but is formed integral therewith. The base component can be cut to a shape to conform to the curvature of the body. That is, the shape of the base component can be easily modified to be used at various locations on the body.

In the preferred embodiments set forth below, the present invention is formed from a thermoplastic material such that it can be immersed in hot water for a period of time, and reshaped over again to fit the framework of any number of sports players. The preferred embodiment of the present invention also includes removable shock absorbing foam inserts which vary in thickness so as to provide more or less shock absorbing capability as desired by the user.

As viewed from the underside of the base component, the preferred embodiment of the present invention incorporates a prominence which has a cavity portion. The depth of the cavity approximates the height the prominence is elevated above the base component. The removable pads therefore have a hole formed in the central portion. The pads are applied to the underside of the base component and adhere thereto by a series of hook and loop strips. The hole of the pads immediately underlie the cavity portion of the raised prominence.

A pair of opposing swivel loops are attached to each side of the base component. Flexible strapping, preferably neoprene, is provided with the invention. A first strap is attached to one of the first pair of swivels, and a second strap is attached to the second of the first pair of swivels. The straps, therefore, are attached to one pair of swivels. The first strap has a length longer than the second strap. The first strap is designed to wrap around the torso of the player where the device is used as an acromioclavicular ("AC") protective pad.

BRIEF DESCRIPTION OF THE DRAWINGS

FIG. 3 is a side perspective view of the invention; and

FIGS. 4A–4C is an exploded perspective view shown from the bottom of the invention, and illustrating the removable shock absorbing pads detached therefrom.

DETAILED DESCRIPTION OF THE INVENTION

Figure 1:
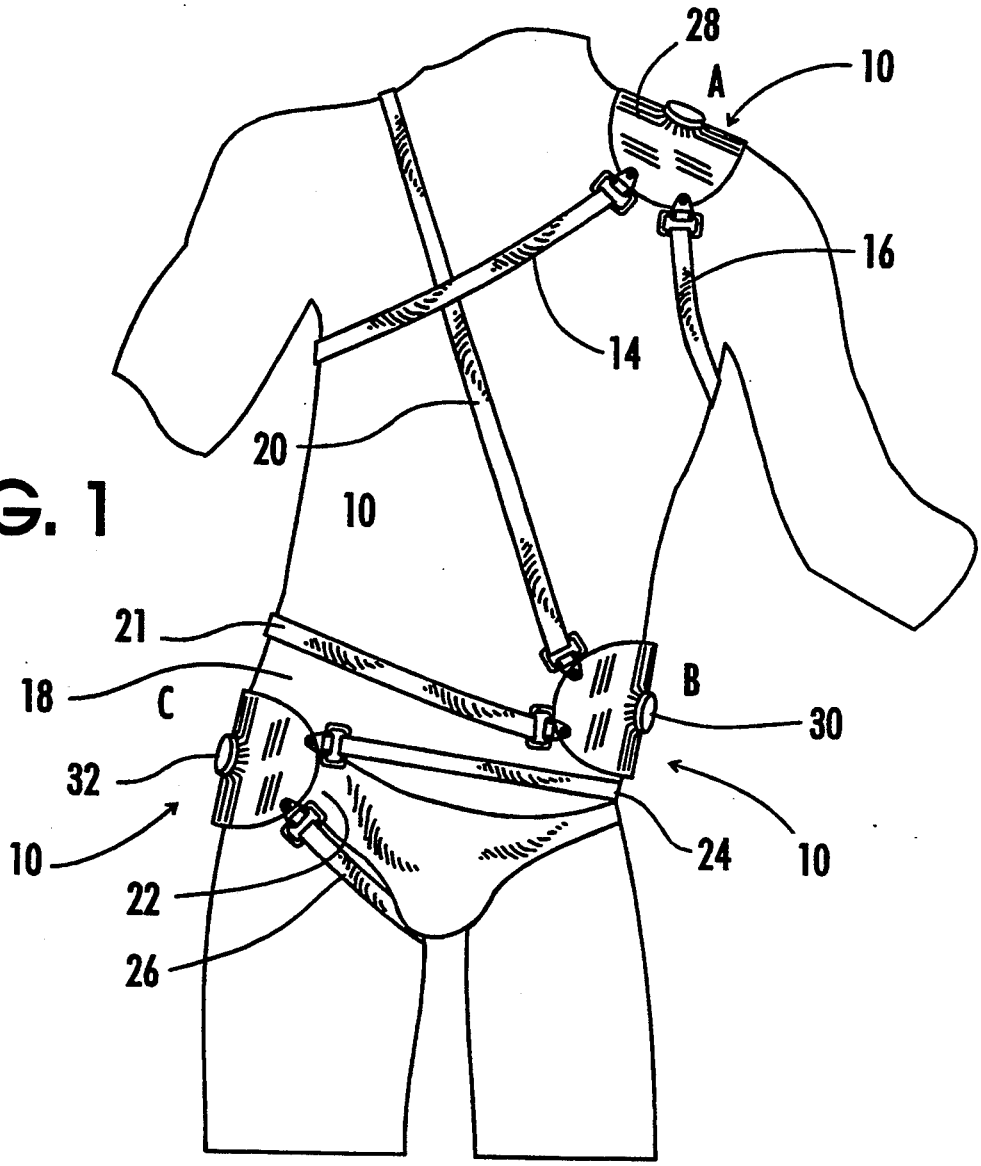
FIG. 1 is a representational view of the preferred embodiment of the invention shown in various positions as applied to the body.

The preferred embodiment designated generally by the reference numeral 10 is shown attached to the user's body in various locations. In a first position, the invention is attached to the user's body at the shoulder region 12 to cover the acromioclavicular joint (not shown) of the body. In this position, straps 14 and 16 wrap around various portions of the torso to hold the invention in place.

Similarly, as shown in the position designated generally at reference letter B, the invention 10 is applied to the torso mid-section 18 and straps 20 and 21 wrap around the torso to hold the invention in its installed position.

Further, as shown in the installed position designated generally by the reference letter C, the invention 10 is applied to the hip region 22, and straps 24 and 26 wrap around the waist and groin area of the wearer. It should be noted that the contour of the human body at position A, B and C may differ. The invention is particularly well suited for the variation and body contour.

The preferred embodiment of the invention is manufactured from a readily thermo-formable material such that it may be immersed in hot water for a period of time, and reshaped in the steaming hot water bath by hand to the contour of the body at the position to which it is to be applied. The material is such that heat rapidly dissipates through convection with the atmosphere, and therefore the shape memory is almost immediate after removing the invention from the steaming hot water bath. The reforming and reshaping steps can be accomplished any number of times as the ability to do so is inherent in the preferred material. 0f course, it is contemplated that the invention can be reformed and shaped using a heat gun.

Figure 2:
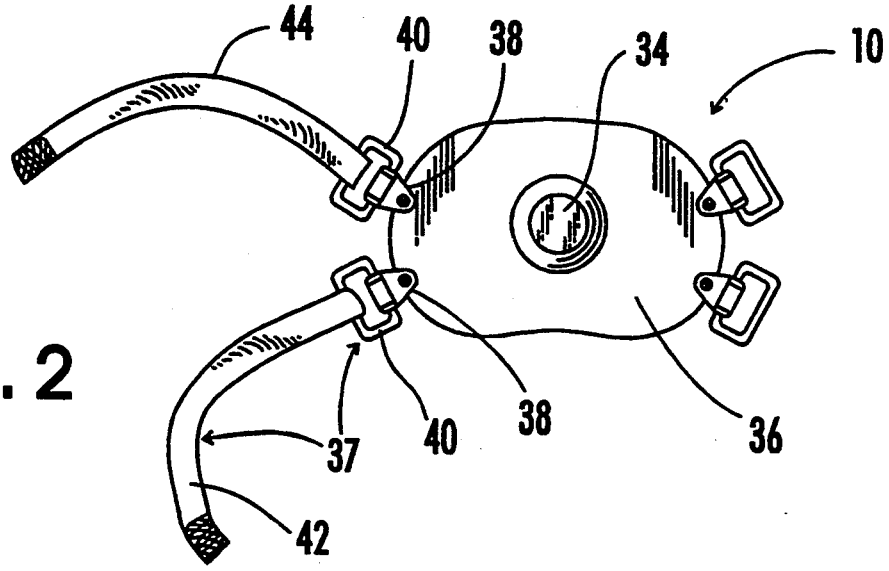
FIG. 2 is a top perspective view of the invention.

As shown in FIG. 1 at positions A, B and C, the prominence 28, 30 and 32 respectively, overlies the area of the body which is to be shielded from impact forces. As best seen in FIGS. 2 through 4, designated generally in those FIGURES as 34, the prominence projects a distance above the surface of the base component 36.

With reference to FIG. 2, the present invention 10 is shaped to fit in the shoulder region as an AC pad. In this fashion, the non-symmetrical nature of the pad causes it to be a left and right only pad. It is contemplated, however, that the present invention can be symmetrically shaped such that a single invention can be used as either a left or a right, so long as the strapping mechanisms 37 permit.

Strapping mechanisms 37 comprise swivels 38 and 40 and straps 42 and 44 and straps 42 and 44 differ in length (FIG. 2). The straps are preferably formed of a flexible, elastic, neoprene material. At least one side of the neoprene material is backed with either a hook or a loop material. The end portions 46 and 48 of the straps have the cooperating hook or loop material so as to cooperatively engage the hook or loop material of the strapping.

With the pad configured like that shown in FIG. 2, the user positions the pad at position A in FIG. 1 by wrapping the longer strap 14 around the torso and the shorter strap 16 under the arm adjacent the placement of the pad 10. The strap is then interlaced between the opposing swivel, pulled taut and wrapped back toward the swivel to which it is attached. The tab having the hook or loop material may then be pressed against the cooperating material of the hook or loop material of the strapping to hold it in place. As shown in position A, the shorter strap is wrapped under the arm attached to the shoulder that is to be protected, inserted through the opposite swivel (not shown), pulled taut and wrapped back toward its anchor swivel. The device of FIG. 2 is now in its installed position as shown at A in FIG. 1.

As best seen in FIG. 3, prominence 34 of the present invention 10 is elevated a distance above the base component 36. Pads 58 varying in thickness are attached to the underside 60 (see FIG. 4A) of the invention. With reference to FIG. 4B and 4C, the pads 58 have strips of hook and loop material 62 which correspond with the hook and loop material 64 attached the underside 60 of the invention 10. The user therefore simply selects the desired thickness of the pad and applies it to the bottom portion 60 of the invention. Holes 66 in pad 58 are positioned to directly underlie the prominence 34.

Accordingly, in any of the installed positions, the upwardly projecting prominence is more likely to first receive the impact impinging in the direction towards the sight to be protected. Impact received by the prominence is dispersed along its sides 70 onto the base 36. The direction of the force therefore, has been, in essence, deflected away from its initial contact angle. The deflection inherently generates multiple force components as shown in FIG. 3. The multiple force components which are the resultant force vectors of the impinging force are of a lesser magnitude than the impinging force. The impinging force therefore, is dissipated along the lines shown as component force vectors.

Accordingly, the present invention is particularly useful for dissipating, dispersing, and redirecting as well as absorbing the impact force impinging on the prominence and base component.

What is claimed is:

1. A thermoformable protective pad to be worn on the human body to shield the body from impact forces, comprising:

a thermoformable base having a top surface, a bottom surface, and an edge forming a boundary for said base;

shock dispersing means projecting above said top surface for receiving and dispersing impact forces;

shock absorbing means adjacent said base for absorbing impact forces; and said thermoformable is capable of withstanding and undergoing repeated heating and reshaping cycles, and said shock dispersing means is integral with and surrounded by said base, enabling said impact forces to be dispersed radially outwardly from said shock dispersing means to said base.

2. The pad of claim 1, further comprising:

securing means for securing said base to the body of the wearer.

3. The pad of claim 2, wherein said securing means comprises:

at least one strap having opposite ends, and at least one pair of attachment loops wherein one of the loops receives one end of said strap and the other of said loops receives the remaining end of said strap.

4. The pad of claim 3, wherein said securing means further comprises:

a swivel pivotal with respect to said base enabling said loop to be attached thereto providing pivotal engagement of said strap with said swivel permitting movement of said strap in three dimensions.

5. The pad of claim 3, wherein said strap further comprises:

a length of flexible hook and loop material such that a first portion of said strap has the hook configuration of said look and loop material and a second portion one of said strap has the loop configuration of said hook and loop material, enabling said first and said second portions to be attached to one another.

6. The pad of claim 1, wherein said shock absorbing means further comprises:

at least one removal pad positioned adjacent said bottom of said base such that said removable pad is shaped to correspond to the shape of said bottom of said base.

7. The removable pad of claim 5, wherein:

said removable pad has a cooperating component of hook and loop material and said bottom of said base has the other corresponding cooperating component of hook and loop material.

8. A protective pad to be worn on the human body adjacent a skeletal joint body from impact forces, comprising:

an arcuate base portion having a top and a bottom, and an edge;

a shock dispersing prominence surrounded by and integral with said base portion, for receiving impact forces and enabling said impact forces to be dispersed outwardly onto said base portion; and shock absorbing means removably attached to said base portion for absorbing impact corces dispersed thereon and wherein the protective pad is constructed of a thermoformable material capable of withstanding and undergoing repeated heating and rashaping cycles.

9. The pad of claim 8, further comprising:

securing means for securing said base to the body of the wearer.

10. The pad of claim 9, wherein said securing means comprises:

at least one strap having opposite ends, and at least one pair of attachment loops wherein one of said loops receives one end of said strap and the other of said loops receives the remaining end of said strap.

11. The pad of claim 10, wherein said strap further comprises:

a length of flexible hook and loop material such that a first portion of said strap has the hook configuration of said hook and loop material and a second portion one of said strap has the loop configuration of said hook and loop material, enabling said first and said second portions to be attached to one another.

12. The pad of claim 8, wherein said shock absorbing means further comprises: at least one removable pad positioned adjacent said bottom of said base portion wherein said pad is sized to correspond to the shape of said bottom of said base portion.

13. The removable pad of claim 12, wherein:

said removable pad has a cooperating component of hook and loop material and said bottom of said base has the other corresponding cooperating component of hook and loop material.

14. A protective joint pad to be worn on the human body adjacent a skeletal joint, comprising:

a shell formed of a thermoformable material capable of being reshaped and reformed after it is reheated and reshaped and comprising an arcuate base having a top, a bottom, a boundary, and a shock dispersing cup means integral with, surrounded by and projecting above said base for receiving and dispersing impact forces outwardly therefrom onto said base;

securing means associated with said shell for securing said shell to the human body adjacent a skeletal joint;

said securing means comprises at least one strap capable of wrapping around a portion of the body of the wearer, and anchor means for receiving said at least one strap means, enabling said at least one strap emanating from one side of said base of said shell to be wrapped around the body of the wearer and engage the opposite side of said base for securing said shell to the body.

15. The pad of claim 14, wherein said shock dispersing cup further comprises:

a projection having an exterior surface raised above said base, and a hollow interior surface.

16. The pad of claim 14, wherein:

said shock dispersing cup means is a cylinder having spaced apart ends and a side wall such that one of said ends is closed and said side wall is integral with said base.

17. The pad of claim 14, wherein said securing means comprises:

at least one strap having opposite ends, and at least one pair of attachment loops wherein one of said loops receives one end of said strap and the other of said loops receives the remaining end of said strap.

18. The pad of claim 17, wherein said strap further comprises:

a length of flexible hook and loop material such that a first portion of said strap has the hook configuration of said hook and loop material and a second portion one of said strap has the loop configuration of said hook and loop material, enabling said first and said second portions to be attached to one another.

19. The pad of claim 14, wherein said pad means further comprises:

pads means, removably attached to said bottom of said base, for absorbing impact forces impinging on said top of said base and said shock dispersing means.

20. The pad of claim 14, wherein said securing means further comprises:

a swivel component pivotal with respect to said base component and a ring attached to said swivel for engagement of said at least one strap.

* * * * *